US005941520A

United States Patent [19]

Stephan et al.

[11] Patent Number: 5,941,520

[45] Date of Patent: Aug. 24, 1999

[54] CONTACT-FREE SHEET GUIDING DEVICE IN A SHEET-FED PRINTING PRESS

[75] Inventors: Günter Stephan, Wiesloch-Baiertal; Peter Thoma, Mannheim, both of Germany

[73] Assignee: Heidelberger Druckmaschinen AG, Heidelberg, Germany

[21] Appl. No.: 08/922,422

[22] Filed: Sep. 3, 1997

[30] Foreign Application Priority Data

Sep. 3, 1996 [DE] Germany ..... 296 15 294
May 26, 1997 [DE] Germany ..... 197 21 907

[51] Int. Cl.[6] ..... B65H 29/24

[52] U.S. Cl. ..... 271/195; 406/88

[58] Field of Search ..... 271/194, 195; 226/97.1, 97.3; 406/86, 88; 34/638, 648

[56] References Cited

U.S. PATENT DOCUMENTS

| | | | |
|---|---|---|---|
| 3,180,688 | 4/1965 | Futer | 406/88 |
| 3,633,281 | 1/1972 | Vits . | |
| 3,975,057 | 8/1976 | Hurd | 271/195 |
| 5,102,118 | 4/1992 | Vits . | |
| 5,546,858 | 8/1996 | Stephan . | |
| 5,836,247 | 11/1998 | Stephan et al. | 271/195 |

FOREIGN PATENT DOCUMENTS

| | | | |
|---|---|---|---|
| 2255072 | 5/1973 | Germany | 406/88 |
| 19 07 083 | 12/1975 | Germany . | |
| 25 24 168 | 5/1977 | Germany . | |
| 39 36 846 C1 | 4/1991 | Germany . | |
| 41 13 465 A1 | 10/1992 | Germany . | |
| 44 10 189 A1 | 9/1995 | Germany . | |
| 44 43 493 A1 | 6/1996 | Germany . | |
| 195 45 799 C1 | 1/1997 | Germany . | |
| 404292327 | 10/1992 | Japan | 406/88 |
| 2 255 079 | 10/1992 | United Kingdom . | |

*Primary Examiner*—H. Grant Skaggs
*Attorney, Agent, or Firm*—Herbert L. Lerner; Laurence A. Greenberg

[57] ABSTRACT

In a sheet-fed printing press, a contact-free sheet guiding device having a sheet guiding surface is provided including at least one blast air nozzle disposed in the sheet guiding surface and having an air guiding surface directed obliquely downwardly with respect to the sheet guiding surface, the air guiding surface defining a cross section of the blast air nozzle disposed obliquely downwardly from the sheet guiding surface, the blast air nozzle being disposed so that a flow direction of blast air emerging from the blast air nozzle encloses, with the sheet guiding surface, a steep angle directed against the sheet from below, the blast air flow having a vertical directional component which is greater than a horizontal directional component thereof.

6 Claims, 1 Drawing Sheet

CONTACT-FREE SHEET GUIDING DEVICE IN A SHEET-FED PRINTING PRESS

BACKGROUND OF THE INVENTION

FIELD OF THE INVENTION

The invention relates to a contact-free sheet guiding device in a sheet-fed printing press having a sheet guiding surface wherein there is provided at least one blast air nozzle having an air guiding surface directed obliquely downwardly with respect to the sheet guiding surface, the air guiding surface defining a cross section of the blast air nozzle disposed obliquely downwardly from the sheet guiding surface.

A sheet guiding device of this general type has become known heretofore from German Patent 19 07 083 wherein, in a guide baffle, blast air nozzles having a cross section in the form of a sector of a ring slot are provided in a surface of the guide baffle, and an air guiding surface is formed extending obliquely downwardly relative to the surface of the guide baffle, and defining the ring slot sector which is located opposite to the air guiding surface. The blast air nozzles of the conventional device shown in the German patent are provided with a guide baffle formed with punched or stamped-out tonguelike notches for producing a directionally focused airflow, with a shallow angle directed in the sheet-feeding direction towards the sheet to be transported which floats above the surface of the guide baffle. A geometrical bottleneck for the air flowing through the respective blast air nozzle is located at an air outlet location. This choke point is followed by a diverging guide surface acting as a diffuser and, in this region, a negative pressure typical for a diffuser is generated which sucks the sheet against the guide face formed by the tonguelike notches. Due to this suction, contact-free sheet guidance is no longer achieved. A consequence thereof is the occurrence of scratches, and smearing of the side of the sheet communicating with the sheet guiding device. Comparable with the foregoing conventional device is the action of a device heretofore known from the published German Patent Document DE 41 13 465 A1.

SUMMARY OF THE INVENTION

It is accordingly an object of the invention to provide a contact-free sheet guiding device having blast air nozzles with the features mentioned at the introduction hereto which is constructed so that the emerging blast air has no negative pressure zones which would otherwise interfere with or disrupt uniform air flow under the sheet to be fed, and ensures contact-free sheet guidance.

With the foregoing and other objects in view, there is provided, in accordance with the invention, in a sheet-fed printing press, a contact-free sheet guiding device having a sheet guiding surface and comprising at least one blast air nozzle disposed in the sheet guiding surface and having an air guiding surface directed obliquely downwardly with respect to the sheet guiding surface, the air guiding surface defining a cross section of the blast air nozzle disposed obliquely downwardly from the sheet guiding surface, the blast air nozzle being disposed so that a flow direction of blast air emerging from the blast air nozzle encloses, with the sheet guiding surface, a steep angle directed against the sheet from below, the blast air flow having a vertical directional component which is greater than a horizontal directional component thereof.

In accordance with another feature of the invention, the air guiding surface is arcuate and is disposed in a vertical section plane parallel to the sheet transport direction.

In accordance with a further feature of the invention, the blast air nozzle is disposed in a baffle plate and has an exit profile which, in plan view, has the shape of a ring slot sector.

In accordance with an added feature of the invention, an additional small opening serving as a blast air outlet is formed in the air guiding surface.

In accordance with an additional feature of the invention, the angle enclosed by the flow direction of the blast air emerging from the blast air nozzle and the sheet guiding surface corresponds substantially to an angle enclosed by the flow direction of the blast air and the underside of a respective sheet to be transported and has a vertex pointing in the sheet travel direction.

In accordance with a concomitant feature of the invention, the blast air nozzle has a given flow cross section, and an opening, which is small in comparison with the given flow cross section of the blast air nozzle, is formed in the air guiding surface.

An angle greater than 45° is thus enclosed by the flow direction of the blast air emerging from the blast air nozzle and the sheet guiding device. Correspondingly, the blast air impinges from below at such an angle on the respective sheet which is being floatingly transported. Consequently, the suction zone at the rim or edge of the blast air nozzle is reduced considerably and its effect is negligibly small. This may be attributed to the fact that when the air impinges on the sheet, impulse forces come into play which counteract the effect of the suction zone.

To achieve the desired goal, the blast air nozzle or nozzles are produced by stamping them out of a baffle plate so as to form an air guiding surface which rises steeply in the sheet travel direction and, in a vertical section plane parallel to the sheet travel direction, enclose an obtuse angle with the sheet guiding surface formed on the baffle plate. Supporting action is provided when the air guiding surface is arcuate or bow-shaped in the aforementioned vertical section plane.

Other features which are considered as characteristic for the invention are set forth in the appended claims.

Although the invention is illustrated and described herein as embodied in a contact-free sheet guiding device in a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
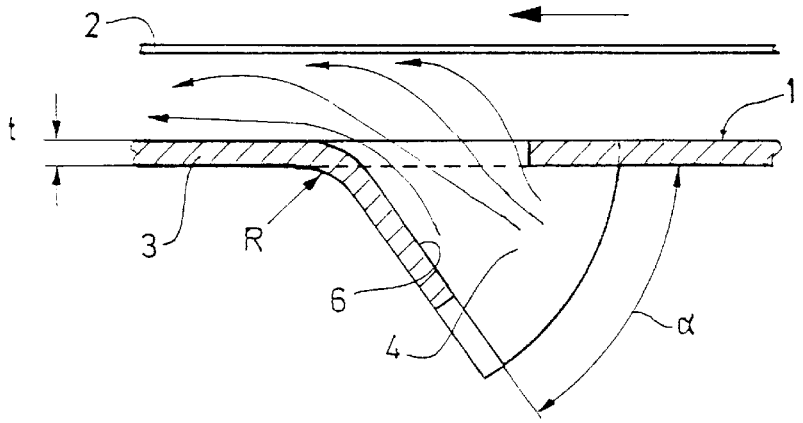
FIG. 1 is a longitudinal sectional view, parallel to a sheet travel direction represented by a horizontal arrow, of a blast air nozzle having a steep outflow angle.

Referring now to the drawing and, first, particularly to FIG. 1 thereof, there is shown therein a sheet guiding surface 1 for contact-free guidance of a sheet 2 floating on an air cushion, the sheet guiding surface being formed on a baffle or guide plate 3. In this baffle plate 3, mutually spaced-apart blast air nozzles 4, only one of which is shown in the drawing, are distributed over the sheet guiding surface 1. Each blast air nozzle 4, respectively, is formed by a rectilinear or curvilinear incision 5 of the baffle plate 3, the incision 5 being disposed transversely to the sheet travel direction, and being formed by being stamped out downwardly opposite to the sheet guiding surface 1 so that, in a vertical section plane taken through the center of the blast air nozzle 4 parallel to the sheet travel direction, a lower blast air guiding surface 6 is produced, which, together with the sheet guiding surface 1, enclose an angle $\alpha$ which is greater than 45° and is preferably 60°. Blast air emerging from the blast air nozzle 4 is consequently directed steeply against the underside of the sheet 2 to be fed, as represented by the symbolic arrows in FIG. 1. This is achieved by the fact that the air emerging from the blast air nozzle 4 has a vertical flow component which is greater than the (horizontal) flow component tangential to the sheet.

Figure 2:
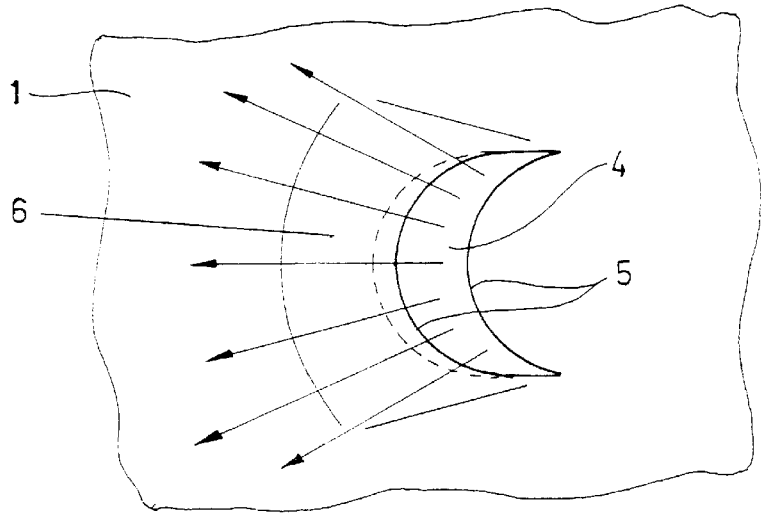
FIG. 2 is a top plan view of FIG. 1 wherein the blast air nozzle is shown formed by a tongue-shaped incision.

FIG. 2 is a top plan view of a blast air nozzle 4 together with a circular arc-shaped incision 5 and a blast air guiding surface 6 widening in the sheet travel direction, however, by employing the features of the invention, other forms of a blast air nozzle are also suitable for preventing a negative pressure or vacuum zone or for at least reducing it to a minimal value at which a smeared appearance no longer occurs. In operation, the blast air nozzle 4 represented in the exemplary embodiment of FIG. 2 produces excess pressure in the jet or scavenging air zone, which compensates for a possible vacuum or negative pressure effect.

A special form for realizing the features of the invention is a blast air nozzle 4 with a sheet guiding surface 6 which has an arcuate or bow-formed contour in a vertical section plane through the center of the blast air nozzle parallel to the sheet transport direction, the arcuate contour, as shown in FIG. 1, having a curvature radius R which is 2 to 5 times the plate thickness t.

Figure 3:
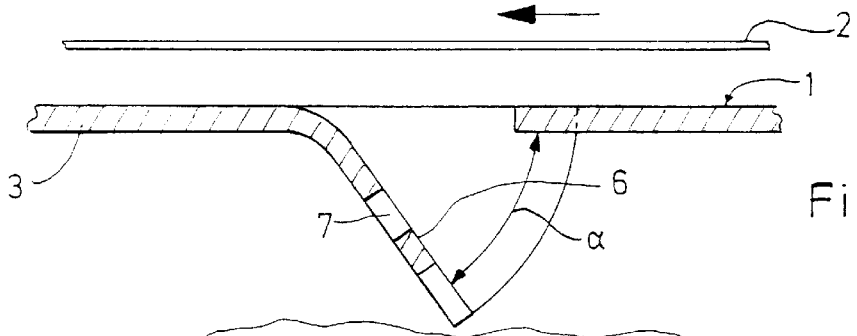
FIG. 3 is a view like that of FIG. 1 of a different exemplary embodiment of the invention formed with an additional opening when compared with FIG. 2.
Figure 4:
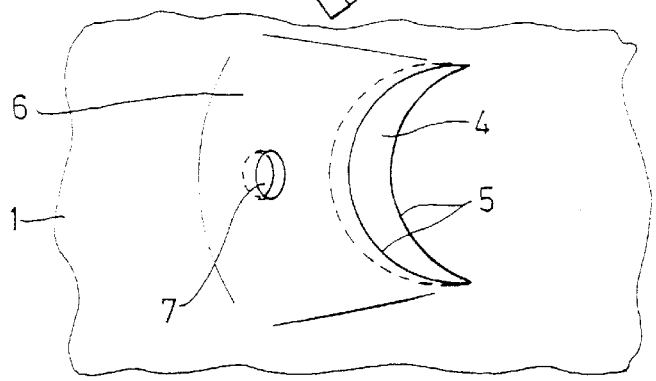
FIG. 4 is a top plan view of FIG. 3.

In the exemplary embodiment represented in FIGS. 3 and 4, the vertical flow component of the nozzle or jet blast air is increased with respect to the horizontal component due to the fact that, in the region of the tongue 6, an additional opening 7 is provided by which an additional quantity of blast air, which is smaller in comparison with the main nozzle flow, is blasted or blown in a substantially vertical manner against the sheet. By suitably shaping the tongue-shaped incision, a blast air nozzle 4 is likewise produced in the form of an annular gap or ring slot sector, which is adjoined in the sheet travel direction by an ascending air guiding surface 6. In a vertical section plane parallel to the sheet feeding direction, at least one additional opening 7 is formed in the air guiding surface 6 according to the exemplary embodiment represented in FIG. 3 so that the blast air emitted from below from the blast air nozzle 4 against the sheet 2 to be transported is directed at an obtuse angle against the underside of the sheet 2.

We claim:

1. In a sheet-fed printing press, a contact-free sheet guiding device having a sheet guiding surface and comprising at least one blast air nozzle disposed in the sheet guiding surface and having an air guiding surface directed obliquely downwardly with respect to the sheet guiding surface, said air guiding surface widening in the sheet travel direction and defining a cross section of the blast air nozzle disposed obliquely downwardly from the sheet guiding surface, said blast air nozzle being disposed so that a flow direction of blast air emerging from said blast air nozzle encloses, with the sheet guiding surface, a steep angle directed against the sheet from below, the blast air flow having a vertical directional component which is greater than a horizontal directional component thereof.

2. The sheet guiding device according to claim 1, wherein said air guiding surface is arcuate and is disposed in a vertical section plane parallel to the sheet transport direction.

3. The sheet guiding device according to claim 2, wherein said blast air nozzle has a given flow cross section, and an opening, which is small in comparison with said given flow cross section of said blast air nozzle, is formed in said air guiding surface.

4. The sheet guiding device according to claim 1, wherein said blast air nozzle is disposed in a baffle plate and has an exit profile which, in plan view, has the shape of a ring slot sector.

5. The sheet guiding device according to claim 1, wherein an additional small opening serving as a blast air outlet is formed in said air guiding surface.

6. The sheet guiding device according to claim 1, wherein said angle enclosed by the flow direction of the blast air emerging from said blast air nozzle and the sheet guiding surface corresponds substantially to an angle enclosed by the flow direction of the blast air and the underside of a respective sheet to be transported, said angle having a vertex pointing in the sheet travel direction.

* * * * *